United States Patent [19]

King

[11] Patent Number: 4,741,845

[45] Date of Patent: May 3, 1988

[54] LUBRICANT ADDITIVE MIXTURES OF ANTIMONY THIOANTIMONATE AND ANTIMONY TRIOXIDE

[75] Inventor: James P. King, Upper Gwynedd, Pa.

[73] Assignee: Pennwalt Corporation, Philadelphia, Pa.

[21] Appl. No.: 937,261

[22] Filed: Dec. 3, 1986

[51] Int. Cl.[4] ..... C10M 125/24
[52] U.S. Cl. ..... 252/18; 252/25
[58] Field of Search ..... 252/25, 18

[56] References Cited

U.S. PATENT DOCUMENTS

| | | | |
|---|---|---|---|
| 3,935,114 | 1/1976 | Donaho, Jr. | 252/25 |
| 3,965,016 | 6/1976 | Soulen | 252/25 |
| 4,465,604 | 8/1984 | King | 252/25 |
| 4,473,481 | 9/1984 | Fukutsuka et al. | 252/26 |
| 4,557,839 | 12/1985 | Tubbs et al. | 252/25 |

*Primary Examiner*—William R. Dixon, Jr.
*Assistant Examiner*—Ellen McAvoy

[57] ABSTRACT

A lubricant additive that includes antimony thioantimonate and antimony trioxide in a specified ratio for enhancing the extreme pressure, antiwear, and antiabrasive properties of conventional lubricants as well as for use in lubrication of a wide variety of lubricated contact surfaces.

24 Claims, No Drawings

LUBRICANT ADDITIVE MIXTURES OF ANTIMONY THIOANTIMONATE AND ANTIMONY TRIOXIDE

BACKGROUND OF THE INVENTION

This invention relates to lubricant compositions that include a mixture of antimony thioantimonate ($SbSbS_4$) and antimony trioxide ($Sb_2O_3$) dispersed in lubricating materials to impart extreme pressure (EP), antiwear and antiabrasive properties to the materials.

Antimony thioantimonate ($SbSbS_4$) is known as a lubricant additive with outstanding EP and antiwear properties (U.S. Pat. No. 3,965,016 that issued June 22, 1976).

Such synergism is surprising as $Sb_2O_3$ per se is not known to enhance lubricating properties of such lubricants. Moreover, significant economic advantages are provided by substitution of the low cost $Sb_2O_3$ for the relatively expensive $SbSbS_4$.

More specifically, this invention concerns lubricating compositions comprising a grease, a mineral oil of lubricating viscosity, a synthetic fluid of lubricating viscosity or a solid lubricant resin binder such as polyimide, polyphenylsulfide, etc., and a synergistic mixture (by weight) of from 0.1% to 20% of antimony thioantimonate ($SbSbS_4$) and from 0.1% to about 20% of antimony trioxide ($Sb_2O_3$). The $SbSbS_4$ and $Sb_2O_3$ mixtures are in a $SbSbS_4/Sb_2O_3$ weight ratio in the range of 0.1 to 10.

SUMMARY OF THE INVENTION

The lubricating composition of this invention is defined as a lubricating composition consisting essentially of, by weight: (i) from about 60% to about 99.8% of a lubricant selected from the group consisting of a grease, a mineral oil of lubricating viscosity, a synthetic fluid of lubricating viscosity and a solid lubricant resin binder; and (ii) a synergistic combination intimately mixed therewith of from about 0.1% to about 20% of $SbSbS_4$ and from about 0.1 to about 20% of $Sb_2O_3$, the $SbSbS_4$ to $Sb_2O_3$ weight ratio being within the range of about 0.1 to 10.

Preferably, the weight ratio is within the range of 0.1 to 5 and the $SbSbS_4$ comprises less than 8% of the composition and, more preferably, the weight ratio is within the range of 0.3 to 5 and the $SbSbS_4$ comprises from 0.5% to 2.0% of the composition.

The lubricants are preferably selected from a mineral oil of lubricating viscosity or a synthetic fluid of lubricating viscosity. More specifically, such lubricants are a silica grease, a clay grease, a lithium grease, or an aluminum complex grease.

The method of the invention includes intimately mixing the above ingredients of the composition.

It is preferred that the $SbSbS_4$ and $Sb_2O_3$ are separately mixed to provide a premix that is then mixed with the lubricant.

The premix of this invention is defined as a mixture of of $SbSbS_4$ and $Sb_2O_3$ in a weight ratio of $SbSbS_4$ to $Sb_2O_3$ within the range of 0.1 to 10 that is useful as a lubricant additive. Preferably, the weight ratio is within the range of 0.3 to 5. Preferably, the $SbSbS_4$ and $Sb_2O_3$ are in the form of a finely divided powder having a particle size within the range of 0.01 micron to about 100 microns and, more preferably, within the range of 0.1 to 10 microns.

This invention includes use of the premix to lubricate surfaces adapted for frictional contact. More specifically, this aspect of the invention is defined as a lubricated contacting surface having a lubricating effective amount of the above $SbSbS_4/Sb_2O_3$ mixture closely adjacent to the surface. The mixture, depending upon the specific context, can be bound to the surface with a resin within which the mixture is dispersed or incorporated and dispersed within the surface.

DESCRIPTION OF THE PREFERRED EMBODIMENTS

The extreme pressure (EP), antiwear and antiabrasive wear additives embodied in the synergistic mixture of the present invention generally are incorporated in lubricant compositions in a particulate form, i.e., as a finely divided powder having a particle size, in general, within the range from 0.01 micron to about 100 microns, and preferably within the range of from 0.1 to about 10 microns.

The composition of this invention is useful for lubricating the contacting surfaces of a wide variety of materials, for example, metals, alloys, ceramics, plastics, cements and other materials, wherein the contacting surfaces may be of the same or different materials. The most important of these compositions are oil, grease, and solid lubricant mixtures having improved extreme pressure and load-carrying capacity and which are prepared by incorporating in an oil, grease or solid resin binder from 0.2 to about 40% by weight of the synergistic mixture of this invention, preferably from 1.0% to about 20% by weight of the composition.

The following examples demonstrate the present invention in which the antimony thioantimonate and antimony trioxide synergistic mixtures are prepared and tested as additives in lubrication compositions.

EXAMPLES 1-5

A lithium grease derived from a mineral oil base fluid thickened with 12-hydroxystearate was separately blended with antimony thioantimonate, antimony trioxide and various ratios of antimony thioantimonate to antimony troxide. The greases were evaluated on Shell Four-ball EP tester and the weld points of these greases were determined (ASTM D 2596). The experimental results are recorded in Table I. Synergism is observed as the weld point of the grease in Example 4 containing 1% $SbSbS_4/Sb_2O_3$ mixture with weight ratio of 4 shows superior performance to the greases containing either 1% of $SbSbS_4$ or $Sb_2O_3$ alone.

EXAMPLES 6-10

To demonstrate the antiabrasive wear properties of the synergistic mixtures of antimony thioantimonate and antimony troxide, a lithium grease containing 2% of an abrasive grit particle with an average particle size of 50 microns (A/C Division of General Motors Corp.) was used as the base grease. $SbSbS_4$, $Sb_2O_3$ and various ratios of $SbSbS_4$ to $Sb_2O_3$ were separately blended into the base grease. A Shell Four-ball EP tester was employed to evaluate the antiabrasive wear properties of these greases. The experimental data are recorded in Table II. Both the average wear scar diameters and weight losses on each set of the used steel balls were obtained. The grease which provides the best performance as indicated by the smallest scar diameter and the lowest weight loss is the one containing a mixture of $SbSbS_4/Sb_2O_3$ in a weight ratio of 4.

EXAMPLES 11–15

To further demonstrate the antiabrasive wear properties of the synergistic mixtures of $SbSbS_4$ and $Sb_2O_3$, a lithium grease containing 2% of a finely divided and highly abrasive iron ore dust (Sidbec Normines, Port Cartier, Canada) was used as the base grease. $SbSbS_4$, $Sb_2O_3$ and various ratios of $SbSbS_4$ to $Sb_2O_3$ mixtures were separately blended into the base grease. As in Examples 6 through 10, the average scar diameters and weight losses of these greases were obtained. The results are listed in Table III. It is clearly demonstrated that those greases containing the $SbSbS_4/Sb_2O_3$ ratios as claimed provide superior performance to the greases containing either $SbSbS_4$ or $Sb_2O_3$ alone.

TABLE I

Shell Four-Ball Lubricating Properties of Lithium Greases Containing Various Additives

| Example | Grease Composition (Weight) | $SbSbS_4/Sb_2O_3$ | Weld Point, kg[a] |
|---|---|---|---|
| 1 | Lithium Grease (L.G.) + 1% $Sb_2O_3$ | (NA) | 200 |
| 2 | L.G. + 0.2% $SbSbS_4$ + 0.8% $SB_2O_3$ | (0.25) | 250 |
| 3 | L.G. + 0.5% $SbSbS_4$ + 0.5% $Sb_2O_3$ | (1.00) | 400 |
| 4 | L.G. + 0.8% $SbSbS_4$ + 0.2% $Sb_2O_3$ | (4.00) | 500 |
| 5 | L.G. + 1% $SbSbS_4$ | (NA) | 400 |

[a]ASTM D 2596 (AISI-52100 steel balls)

TABLE II

Shell Four-Ball Lubricating Properties[a] of Lithium Grease Containing a Grit Material

| Example | Grease Composition | $SbSbS_4/Sb_2O_3$ | Ave. Scar Dia., mm | Wt. Loss, mg |
|---|---|---|---|---|
| 6 | Base Grease (B.G.)[b] + 1% $Sb_2O_3$ | (NA) | 2.19 | 7.8 |
| 7 | B.G. + 0.2% $SbSbS_4$ + 0.8% $Sb_2O_3$ | (0.25) | 1.75 | 3.2 |
| 8 | B.G. + 0.5% $SbSbS_4$ + 0.5% $Sb_2O_3$ | (1.00) | 1.68 | 3.2 |
| 9 | B.G. + 0.8% $SbSbS_4$ + 0.2% $Sb_2O_3$ | (4.00) | 1.24 | 1.8 |
| 10 | B.G. + 1% $SbSbS_4$ | (NA) | 1.35 | 2.2 |

[a]AISI-52100 steel balls; 1800 rpm and 80 kg for 5 minutes.
[b]Base grease: Lithium grease containing 2% abrasive dust (A/C Division of General Motors Corp.)

TABLE III

Shell Four-Ball Lubricating Properties of Lithium Grease Containing Iron Ore Dust[a,b]

| Example | Grease Composition | $SbSbS_4/Sb_2O_3$ | Ave. Scar Dia., mm | Wt. Loss, mg |
|---|---|---|---|---|
| 11 | Base Grease (B.G.)[c] + 1% $Sb_2O_3$ | (NA) | 2.25 | 8.1 |
| 12 | B.G. + 0.2% $SbSbS_4$ + 0.8% $Sb_2O_3$ | (0.25) | 1.62 | 2.7 |
| 13 | B.G. + 0.5% $SbSbS_4$ + 0.5% $Sb_2O_3$ | (1.00) | 1.49 | 1.8 |
| 14 | B.G. + 0.8% $SbSbS_4$ + 0.2% $Sb_2O_3$ | (4.00) | 1.32 | 2.2 |
| 15 | B.G. + 1% $SbSbS_4$ | (NA) | 1.37 | 1.8 |

[a]Iron ore dust mined from Sidbec Normines.
[b]AISI-52100 steel balls; 1800 rpm and 80 kg for 5 minutes.
[c]Base grease: Lithium grease containing 2% iron ore dust.

Similar results can be observed with other lubricants such as a silica grease, a clay grease, a lithium grease, or an aluminum complex grease as well as a mineral oil of lubricating viscosity or a synthetic fluid of lubricating viscosity.

Similar synergistic lubricating effects can be observed when the $SbSbS_4/Sb_2O_3$ mixture is dispersed in a resin binder such as polyimide or polyphenylsulfide.

The $SbSbS_4/Sb_2O_3$ mixtures can be used as lubricant compositions per se by applying them to the surface requiring lubrication either alone or in combination with other solid lubricants. Such use is especially applicable where very high operating temperatures are involved so that base greases or oils would decompose at the operating temperatures. The mixtures can also be held closely adjacent to the contacting surfaces with a resin type binder or by incorporation directly into the surface as with a pigment. Numerous applications with respect to virtually any type surface requiring lubrication are possible. For example, the sliding surfaces in an auto sunroof (where grease should be avoided) could be so lubricated, with the premix being either resin bound to the surface or incorporated within the surface in a pigment-like fashion.

I claim:

1. A lubricating composition consisting essentially of, by weight: (i) from about 60% to about 99.8% of a lubricant selected from the group consisting of a grease, a mineral oil of lubricating viscosity, a synthetic fluid of lubricating viscosity and a solid lubricant resin binder; and (ii) a synergistic combination intimately mixed therewith of from about 0.1% to about 20% of $SbSbS_4$ and from about 0.1 to about 20% of $Sb_2O_3$, the $SbSbS_4$ to $Sb_2O_3$ weight ratio being within the range of about 0.1 to 10.

2. The composition of claim 1 wherein the weight ratio is within the range of 0.1 to 5 and the $SbSbS_4$ comprises less than 8% of the composition.

3. The composition of claim 1 wherein the weight ratio is within the range of 0.3 to 5 and the $SbSbS_4$ comprises from 0.5% to 2.0% of the composition.

4. The composition of claim 1, 2, or 3 wherein the lubricant is selected from a silica grease, a clay grease, a lithium grease, or an aluminum complex grease.

5. The composition of claim 2 wherein the lubricant is a mineral oil of lubricating viscosity or a synthetic fluid of lubricating viscosity.

6. The composition of claim 1, 2, 3, or 5 wherein the $SbSbS_4$ and $Sb_2O_3$ are in the form of a finely divided powder having a particle size within the range of 0.01 micron to about 100 microns.

7. The composition of claim 1, 2, 3, or 5 wherein the $SbSbS_4$ and $Sb_2O_3$ are in the form of a finely divided powder having a particle size within the range of 0.1 micron to about 10 microns.

8. A method for manufacturing a lubricating composition which includes intimately mixing, by weight: (i) from about 60% to about 99.8% of a lubricant selected from the group consisting of a grease, a mineral oil of lubricating viscosity, a synthetic fluid of lubricating viscosity and a solid lubricant resin binder; and (ii) a synergistic combination of from about 0.1% to about 20% of $SbSbS_4$ and from about 0.1% to about 20% of $Sb_2O_3$, the $SbSbS_4$ to $Sb_2O_3$ weight ratio being within the range of about 0.1 to 10.

9. The method of claim 8 wherein the weight ratio is within the range of 0.1 to 5 and the $SbSbS_4$ comprises less than 8% of the composition.

10. The method of claim 8 wherein the weight ratio is within the range of 0.3 to 5 and the $SbSbS_4$ comprises from 0.5% to 2.0% of the composition.

11. The method of claim 8, 9, or 10 wherein the lubricant is selected from a silica grease, a clay grease, a lithium grease, or an aluminum complex grease.

12. The method of claim 9 wherein the lubricant is a mineral oil of lubricating viscosity or a synthetic fluid of lubricating viscosity.

13. The method of claim 8, 9, 10, or 12 wherein the $SbSbS_4$ and $Sb_2O_3$ are in the form of a finely divided powder having a particle size within the range of 0.01 micron to about 100 microns.

14. The method of claim 8, 9, 10, or 12 wherein the $SbSbS_4$ and $Sb_2O_3$ are in the form of a finely divided powder having a particle size within the range of 0.1 micron to about 10 microns.

15. The method of claim 8, 9, 10, or 12 wherein the $SbSbS_4$ and $Sb_2O_3$ are separately mixed to provide a premix that is then mixed with the lubricant.

16. A mixture of $SbSbS_4$ and $Sb_2O_3$ in a weight ratio of $SbSbS_4$ to $Sb_2O_3$ within the range of 0.1 to 10 that is useful as a lubricant additive.

17. The mixture of claim 16 wherein the ratio is 0.3 to 5.

18. The mixture of claim 16 or 17 wherein the $SbSbS_4$ and $Sb_2O_3$ are in the form of a finely divided powder having a particle size within the range of 0.01 micron to about 100 microns.

19. The mixture of claim 16 or 17 wherein the $SbSbS_4$ and $Sb_2O_3$ are in the form of a finely divided powder having a particle size within the range of 0.1 microns to about 10 microns.

20. A lubricated contacting surface having a lubricating effective amount of the mixture of claim 16 closely adjacent to the surface.

21. The lubricated surface of claim 20 wherein the $SbSbS_4$ and $Sb_2O_3$ are in the form of a finely divided powder having a particle size within the range of 0.01 micron to about 100 microns.

22. The lubricated surface of claim 20 wherein the $SbSbS_4$ and $Sb_2O_3$ are in the form of a finely divided powder having a particle size within the range of 0.1 micron to about 10 microns.

23. The lubricated surface of claim 20, 21, or 22 wherein the mixture of claim 16 is bound to the surface with a resin within which the mixture is dispersed.

24. The lubricated surface of claim 20, 21, or 22 wherein the mixture of claim 16 is incorporated and dispersed within the surface.

* * * * *